US006611992B1

(12) United States Patent
Arnaud

(10) Patent No.: US 6,611,992 B1
(45) Date of Patent: Sep. 2, 2003

(54) GATE HINGE AND METHOD FOR MOUNTING GATE OPENER

(76) Inventor: Roger Regan Arnaud, P.O. Box 2713, Stateline, NV (US) 89449-2713

( * ) Notice: Subject to any disclaimer, the term of this patent is extended or adjusted under 35 U.S.C. 154(b) by 0 days.

(21) Appl. No.: 10/197,761

(22) Filed: Jul. 16, 2002

Related U.S. Application Data

(63) Continuation of application No. 09/717,692, filed on Nov. 22, 2000, now abandoned.

(51) Int. Cl.[7] ..... E05D 7/06

(52) U.S. Cl. ..... 16/239; 16/367; 16/86.1; 16/DIG. 7; 49/226; 49/232

(58) Field of Search ..... 16/239, 367, 237, 16/238, 86.2, 86.1, DIG. 7; 49/139, 192, 236, 240, 245, 280, 226, 232

(56) References Cited

U.S. PATENT DOCUMENTS

| | | | | | |
|---|---|---|---|---|---|
| 1,123,913 | A | | 1/1915 | Mueller | |
| 4,233,708 | A | | 11/1980 | Bonar | 16/152 |
| 4,330,958 | A | * | 5/1982 | Richmond | 49/280 |
| 4,509,577 | A | | 4/1985 | Priefert | 160/328 |
| 4,549,369 | A | * | 10/1985 | Foley, Jr. | 42/279 |
| 4,658,543 | A | | 4/1987 | Carr | 49/139 |
| 4,970,826 | A | | 11/1990 | Richmond et al. | 49/139 |
| 5,050,344 | A | | 9/1991 | Skeem | 49/237 |
| 5,263,281 | A | * | 11/1993 | Osborn | 49/280 |
| 5,282,336 | A | | 2/1994 | Tucker | 49/21 |
| 5,440,838 | A | * | 8/1995 | Lesser | 49/340 |
| 5,592,717 | A | | 1/1997 | Longo | 16/367 |
| 5,657,809 | A | | 8/1997 | Longoria et al. | 160/369 |
| 5,869,940 | A | | 2/1999 | Parsadayan | 318/461 |
| 6,009,670 | A | * | 1/2000 | Howard | 49/340 |
| 6,192,629 | B1 | | 2/2001 | Akins et al. | 49/382 |

* cited by examiner

*Primary Examiner*—Chuck Y. Mah
(74) *Attorney, Agent, or Firm*—Sierra Patent Group, Ltd.

(57) ABSTRACT

The disclosed device is directed toward a lifting gate. The lifting gate comprises a barrier member having a top and a bottom opposite thereof. A top bracket assembly is coupled to the top of the barrier member. The top bracket assembly includes a top bearing coupled to a top bracket and a top hinge support coupled to the top bearing. A bottom bracket is coupled to the bottom of the barrier member, having a body defined by a first bracket end and a second bracket end and a central bracket portion between the first and second bracket ends. The bottom bracket is coupled to the bottom of the barrier member proximate to the first bracket end. A bottom bearing is coupled to the bottom bracket proximate to the central bracket portion. A bottom hinge support has a first support end and a second support end opposite thereof, and a central support portion between the first and second support ends. The bottom hinge support is coupled to the bottom bearing proximate to the central support portion. A connecting rod is coupled between the top bearing and the bottom bearing. A gate opener has a first opener end and a second opener end opposite thereof. The gate opener is coupled to the bottom hinge support and the gate opener is coupled to the bottom bracket. The lifting gate also includes a biasing member coupled to the bottom hinge support and coupled to the bottom bracket.

14 Claims, 14 Drawing Sheets

GATE HINGE AND METHOD FOR MOUNTING GATE OPENER

CROSS REFERENCE TO RELATED APPLICATIONS

This application is a Continuation of U.S. patent application Ser. No. 09/717,692, filed Nov. 22, 2000, now abandoned.

BACKGROUND

1. Field of Invention

This invention relates to an actuator arm gate opener for controlled swinging gates, specifically to gate hinges that lift the gate as the gate swings open.

Gates have been in use since before recorded history for both functional and aesthetic purposes in providing selected access. Most gates swing from a vertical post between an open and closed position. Gate hinges have been made available for attaining lift as a way to clear the rising path of contouring terrain immediately adjacent the gate. In prior art, hinges provide for only a small lift and do not allow for site conditions where the terrain steeply rises adjacent the gate. Until now the only available gates that can accommodate steep and/or snow site conditions are barrier gates that vertically rise above the path way and sliding gates that roll laterally in and out of the path way. In residential installations vertically lifting barrier gates and sliding gates are not aesthetically pleasing nor are they as practical to install as the traditional swinging gate.

A rear view of a prior art non-lifting gate is illustrated in FIG. 1 (rear view gate closed). The gate 110 is composed of a barrier element 112 attached to the top bracket 118 and the bottom bracket 122. The bearings 124 attach to the top hinge support 116 and the bottom hinge support 120. The hinge supports attach to the column 114. The prior art gate 110 is limited to opening and closing through a horizontal path. The prior art gate 110 is not effective in applications where the location of the gate is in uneven terrain such as sloped driveways and where obstacles such as snow will be present to obstruct the path of the gate.

Several different approaches to lifting a swinging gate include U.S. Pat. No. 4,658,543 to Carr (1987) which shows a complex hinge system that swings while a lifting cylinder lifts the gate simultaneously. This is an overly expensive and complex solution to a high lift swinging gate, and U.S. Pat. No. 5,050,344 to Skeem which uses a hydraulic lifting drum and sliding hinge pins to accomplish the same.

Although prior art does provide for different types of lifting hinges that utilize a rearward inclination of the top and bottom hinge axes to achieve lift during the opening rotation of the gate hinge. These gate hinges require proportionally more force to open the gate as the lift or rearward inclination of the hinge is increased. Examples of these lifting hinges include U.S. Pat. No. 4,233,708 to Bonar (1978) where a rearward inclination of gate hinge axes is on the side of the post and U.S. Pat. No. 5,592,717 to Longo (1997) where the same inclination of hinge axes is located at the back of the post, with a hinge rod and an impractical series of clamps and bolts to allow for limited adjustment of an additional skewing of the hinge axes to keep the gate from leaning back as it rotates and lifts.

All the lifting hinges utilizing rearward inclination of axes as cited above were not commercially successful and the heretofore known prior art suffers from a number of disadvantages: the higher the lift or rearward inclination of the hinge axes, the more force required to open the gate; the force to open and lift the gate is large enough to require that only smaller gates be used; once the gate is open there is always a danger that it can slam shut, the prior art has no counterbalancing of gate when it is open; gates that need to be lifted high have no commercially available openers that can track the geometry of the rising gate; low and high lift gates must be heavily made and structurally reinforced at the point of attachment of the gate opener to withstand the strong pull of the gate opener; gates don't initially lift as quickly as possible because the hinge geometry is not optimized; and the aesthetically unpleasing actuator must be located at the front or rear of the hinge bearing column to operate the gate.

SUMMARY

The present invention relates generally to gate hinges, with a preset mounting for gate opening operators, and pertains more specifically to a gate hinge which enables high lifting of the gate to compensation for snow on the ground and/or for the contour of the terrain at the site of the gate to mechanically lift the gate to follow the contour immediately adjacent the gate for appropriate fit with respect to the ground during the operation of the gate.

Accordingly, the present invention provides a gate hinge, which takes into account steeply sloping contour of the terrain and/or snow in the vicinity of the gate and, attains several objects and advantages, some of which are summarized as follows:

Enables compensation for a steeply sloping contour and/or snow immediately adjacent to the gate to assure that the gate follows the steeply sloping contour as the gate swings between a closed position and an open position by using a counterbalance to negate the high turning force associated with lifting a gate at a high rate. Still further objects and advantages will become apparent from a consideration of the ensuing description and drawings.

The disclosed device is directed toward a lifting gate. The lifting gate comprises a barrier member having a top and a bottom opposite thereof. A top bracket assembly is coupled to the top of the barrier member. The top bracket assembly includes a top bearing coupled to a top bracket and a top hinge support coupled to the top bearing. A bottom bracket is coupled to the bottom of the barrier member, having a body defined by a first bracket end and a second bracket end and a central bracket portion between the first and second bracket ends. The bottom bracket is coupled to the bottom of the barrier member proximate to the first bracket end. A bottom bearing is coupled to the bottom bracket proximate to the central bracket portion. A bottom hinge support has a first support end and a second support end opposite thereof, and a central support portion between the first and second support ends. The bottom hinge support is coupled to the bottom bearing proximate to the central support portion. A connecting rod is coupled between the top bearing and the bottom bearing. A gate opener has a first opener end and a second opener end opposite thereof. The gate opener is coupled to the bottom hinge support and the gate opener is coupled to the bottom bracket. The lifting gate also includes a biasing member coupled to the bottom hinge support and coupled to the bottom bracket.

In another embodiment of the lifting gate the first opener end of the gate opener is coupled to the bottom hinge support at a gate opener swivel joint located proximate to the second support end. The second opener end of the gate opener is coupled to the bracket mount located on the bottom bracket between the central bracket portion and the first bracket end. The biasing member includes a first end and a second end opposite thereof. The first end of the biasing member is coupled to the bottom hinge support proximate to the second support end and the second end of the biasing member is coupled to the bottom bracket proximate to the second bracket end.

Yet another embodiment of the lifting gate includes having the first opener end of the gate opener coupled to the bottom hinge support at a gate opener swivel joint located proximate to the second support end. The second opener end of the gate opener is coupled to a bracket mount located on the bottom bracket between the central bracket portion and the first bracket end. The first end of the biasing member is coupled to the bottom hinge support proximate to the gate opener swivel joint located proximate to the second support end. The second end of the biasing member is coupled proximate to the bracket mount located on the bottom bracket between the central bracket portion and the first bracket end.

Still another embodiment of the lifting gate includes having the first opener end of the gate opener coupled to the bottom hinge support at a gate opener swivel joint located proximate to the second support end. The second opener end of the gate opener is coupled to a bracket mount located on the bottom bracket between the central bracket portion and the first bracket end. The first end of the biasing member is coupled to the bottom hinge support proximate to the second support end and the second end of the biasing member is coupled at the bracket mount located on the bottom bracket between the central bracket portion and the first bracket end.

Another embodiment of the lifting gate includes having the first opener end of the gate opener coupled to the bottom hinge support at a gate opener swivel joint located proximate to the second support end. The second opener end of the gate opener is coupled to a gate swivel joint located on the bottom bracket proximate to the second bracket end. The first end of the biasing member is coupled to the bottom hinge support proximate to the second support end. The second end of the biasing member is coupled to the bottom bracket between the central bracket portion and the first bracket end.

A further embodiment of the lifting gate includes having the first opener end of the gate opener coupled to the bottom hinge support at a gate opener swivel joint located proximate to the second support end. The second opener end of the gate opener is coupled to a gate swivel joint located on the bottom bracket proximate to the second bracket end. The biasing member is a compression biasing member. The first end of the compression biasing member is coupled to the bottom hinge support proximate to the second support end. The second end of the compression biasing member is coupled to the bottom bracket between the central bracket portion and the first bracket end.

DETAILED DESCRIPTION

Figure 1:
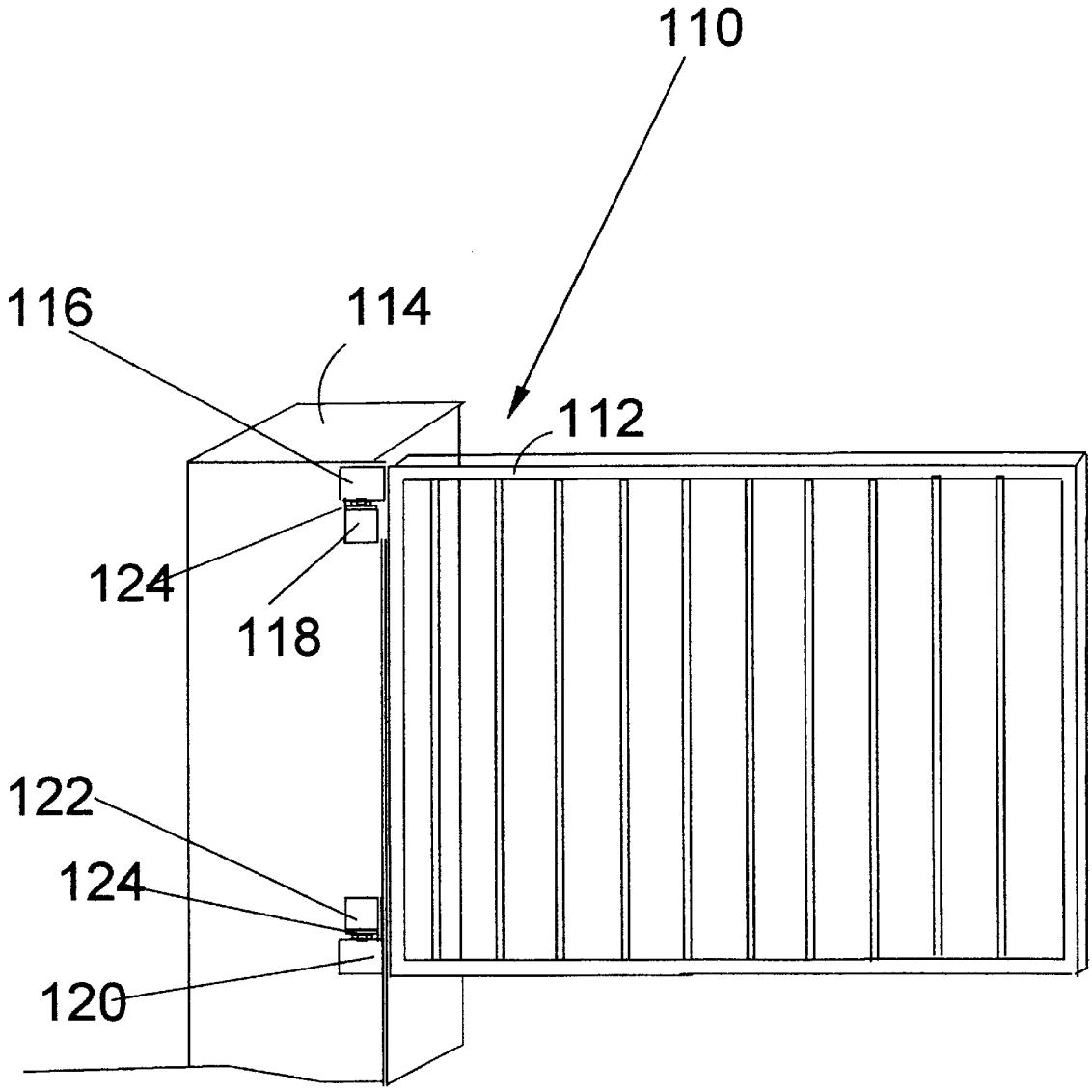
FIG. 1 ( prior art )
FIG. 1 is a rear elevation view of a prior art gate in the closed position with non-lifting hinges.
Figure 2:
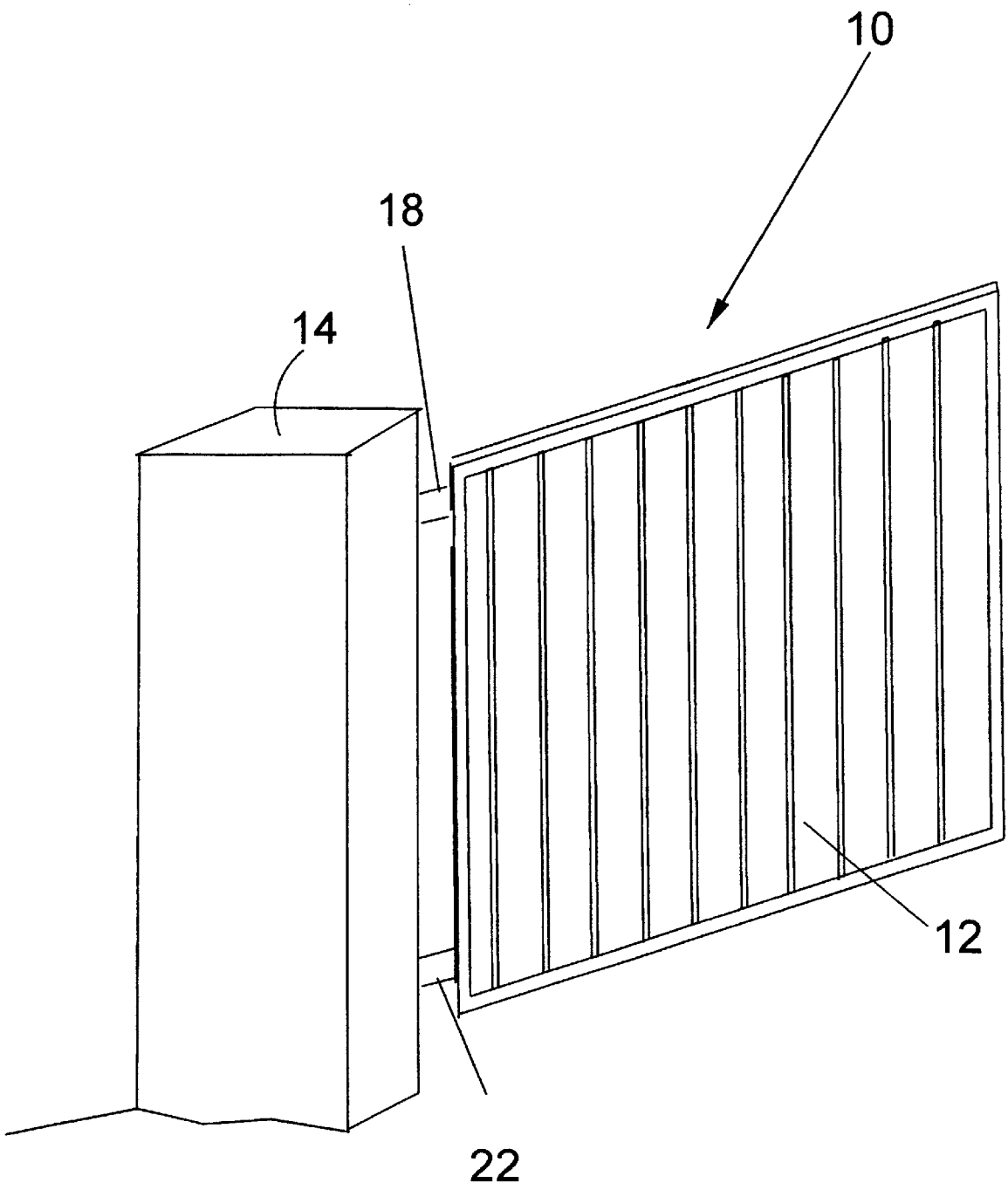
FIG. 2 is a front elevation view of an exemplary lifting gate installation in the half-open position.

FIG. 2 illustrates a front elevation view of an exemplary lifting gate 10 in the half open position. The gate 10 is composed of a barrier element 12 attached to a top bracket 18 and a bottom bracket 22. The hinge supports (not shown) attach to a column 14. In contrast to the prior art gate 110 shown in FIG. 1, the exemplary lifting gate 10 is capable of opening out of the horizontal plane of the terrain surrounding the gate. As is shown in FIG. 2, the barrier element 12 is being raised as well as sweeping open.

Figure 3:
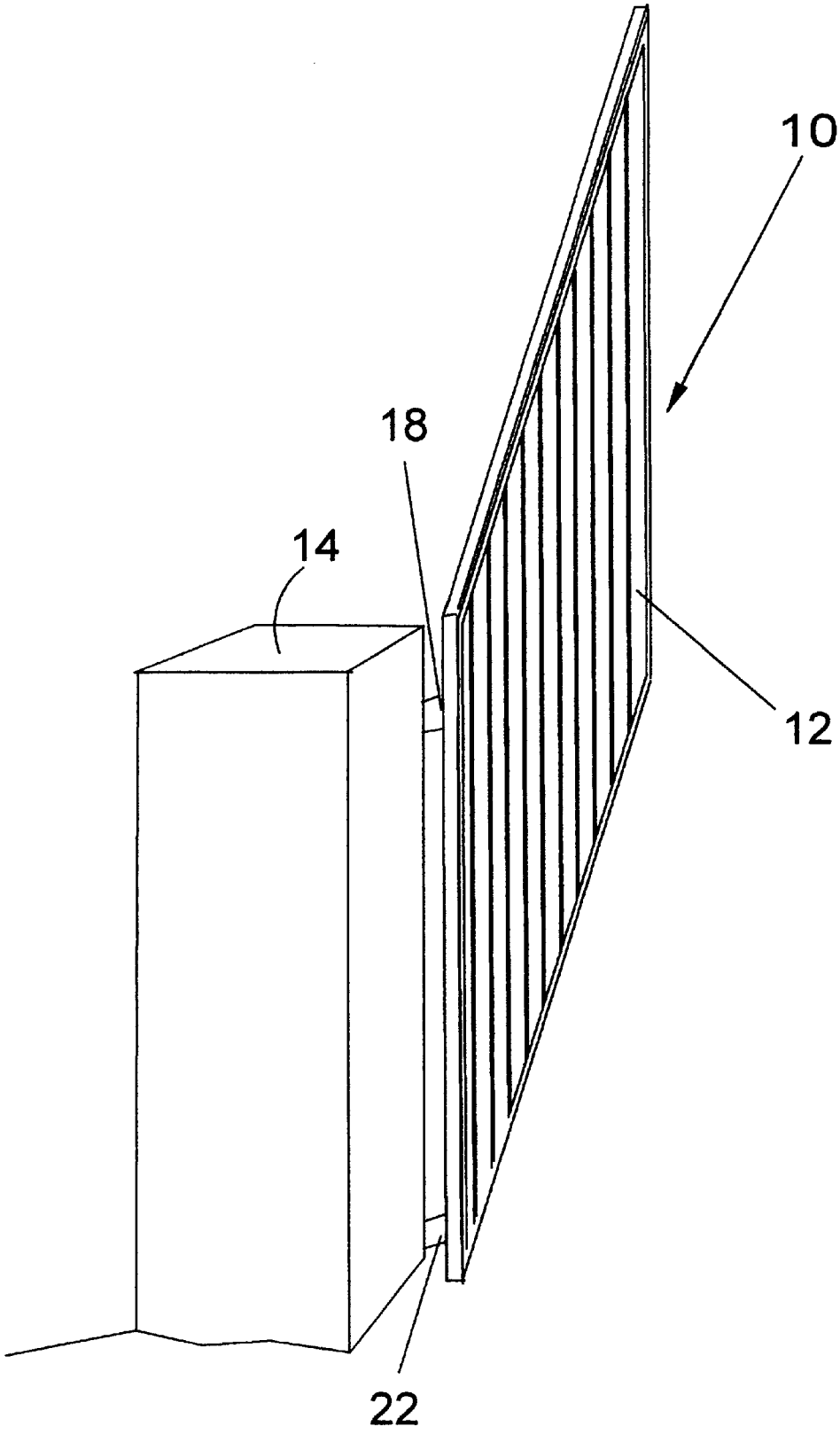
FIG. 3 is a front elevation view of an exemplary lifting gate installation in the full open position.

FIG. 3 illustrates a front elevation view of the exemplary lifting gate 10 in a full open position. The gate 10 is composed of the barrier element 12 attached to the top bracket 18 and the bottom bracket 22. The hinge supports attach to the column 14. As shown in FIG. 3, the barrier element 12 is situated in a position that is both raised and retracted. The position of the barrier element 12 allows for applications of the lifting gate 10 near uneven surfaces as well as accommodating obstructions such as snow.

Figure 4:
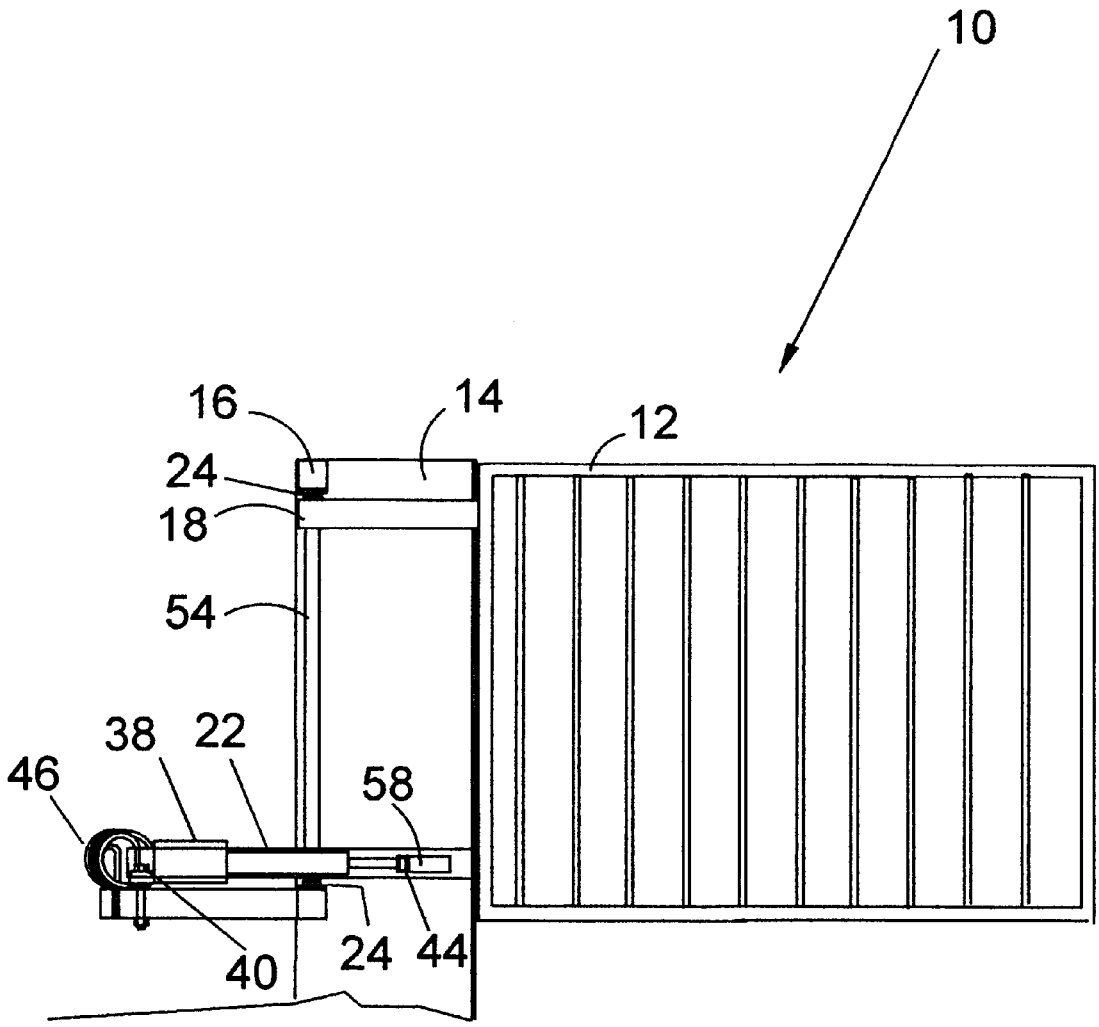
FIG. 4 is a front elevation view of an exemplary lifting gate installation in the closed position.
Figure 5:
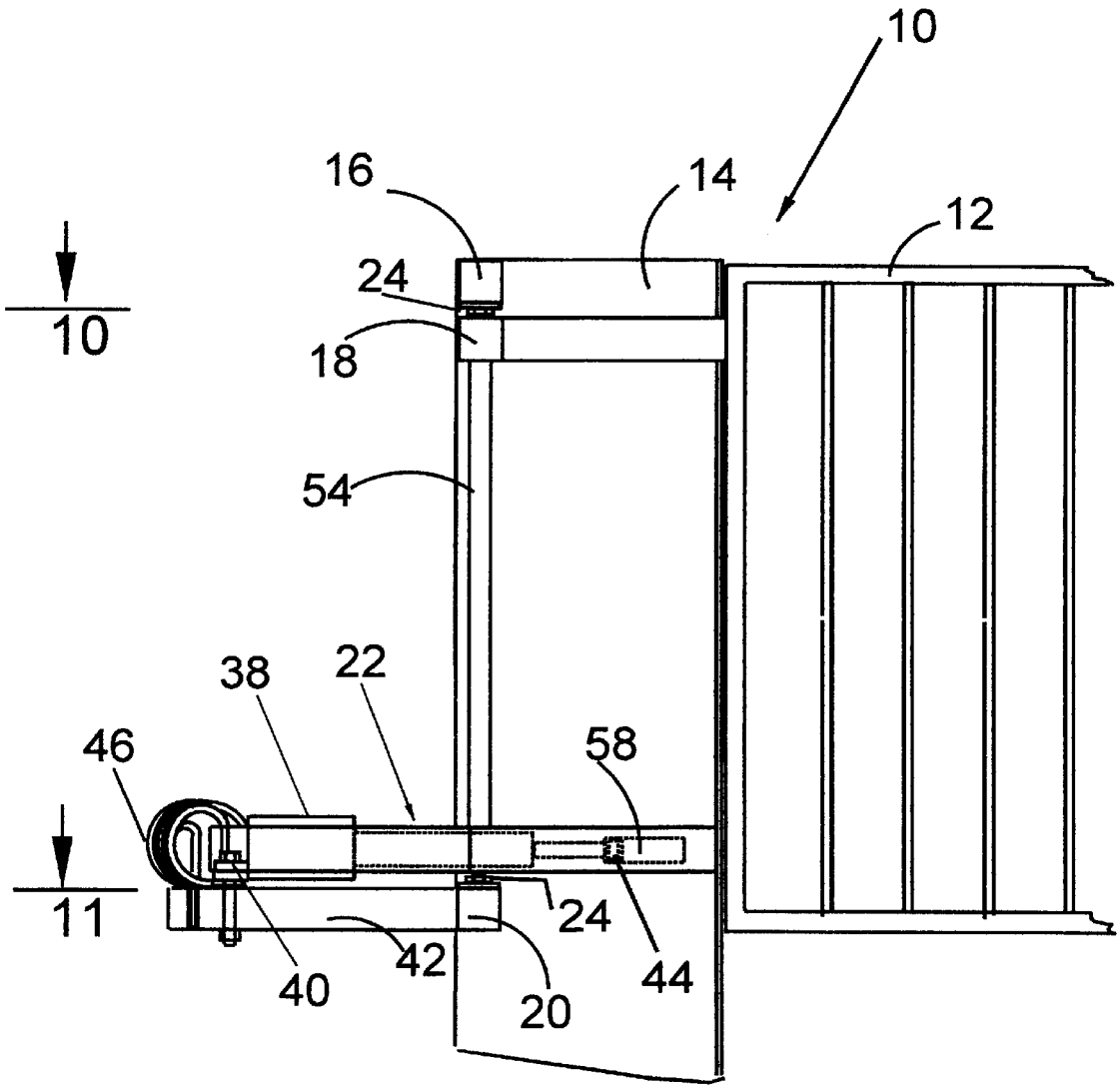
FIG. 5 is a rear elevation view of an exemplary lifting gate installation in the closed position.
Figure 6:
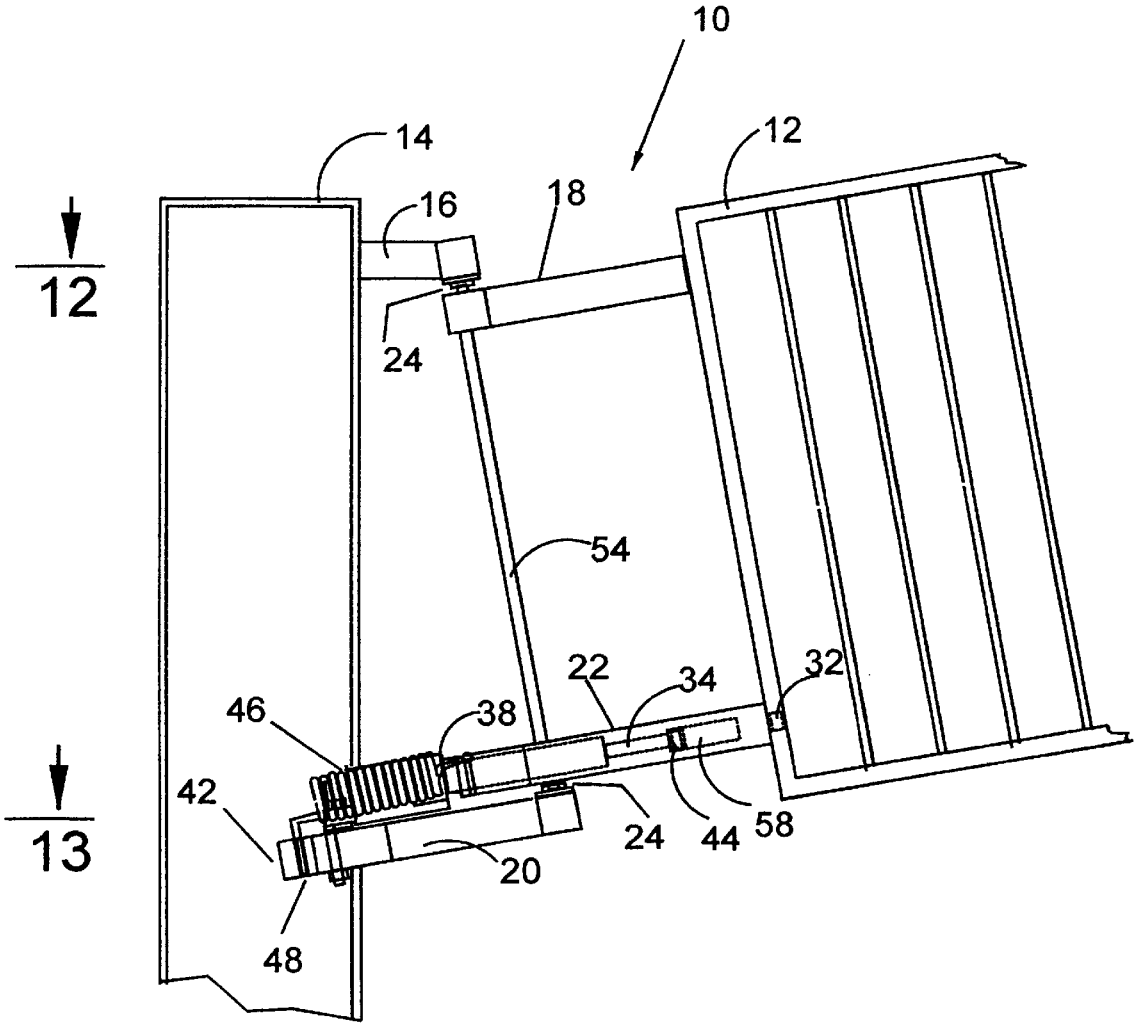
FIG. 6 is a side elevation view of an exemplary lifting gate installation in the open position.
Figure 10:
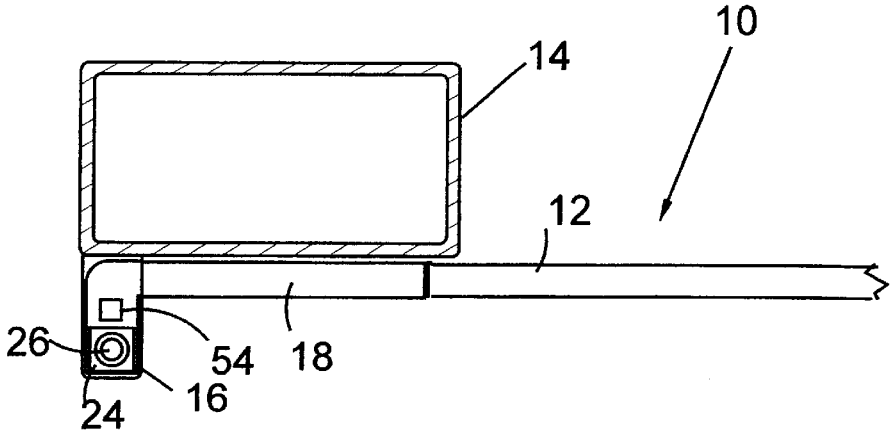
FIG. 10 is a cross-sectional view taken along the line 10—10 of FIG. 5.
Figure 11:
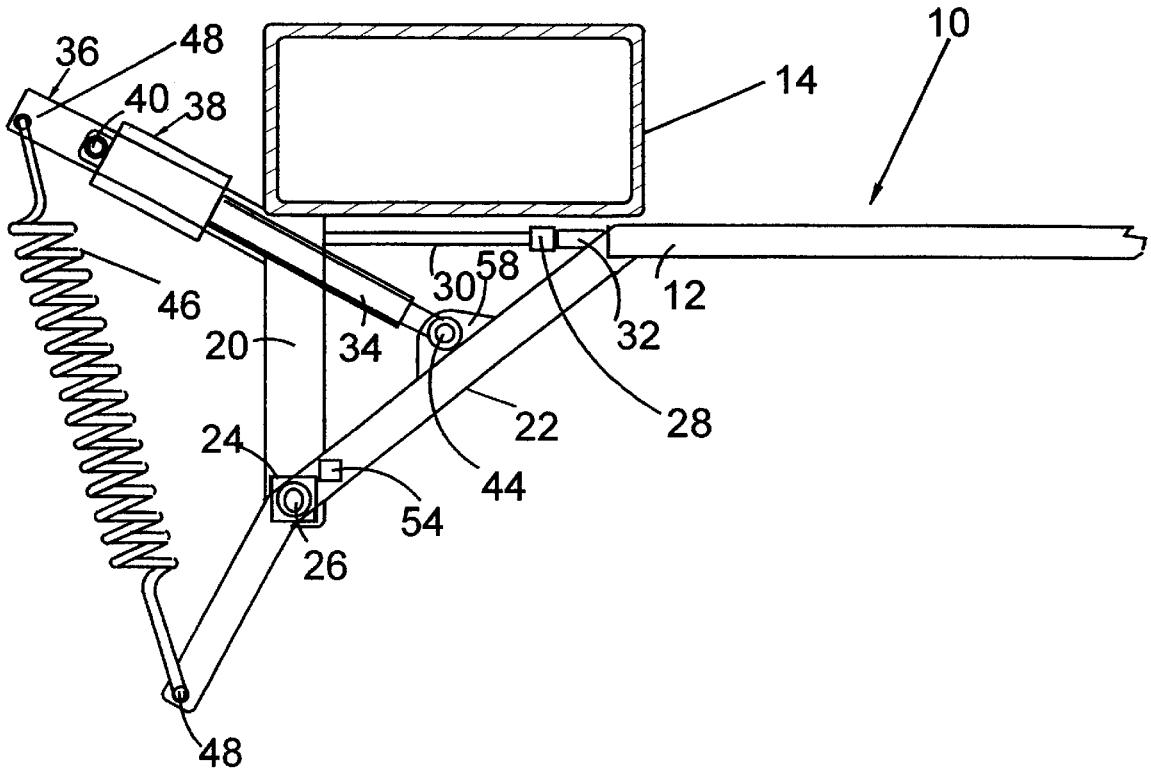
FIG. 11 is a cross-sectional view taken along the line 11—11 of FIG. 5.
Figure 12:
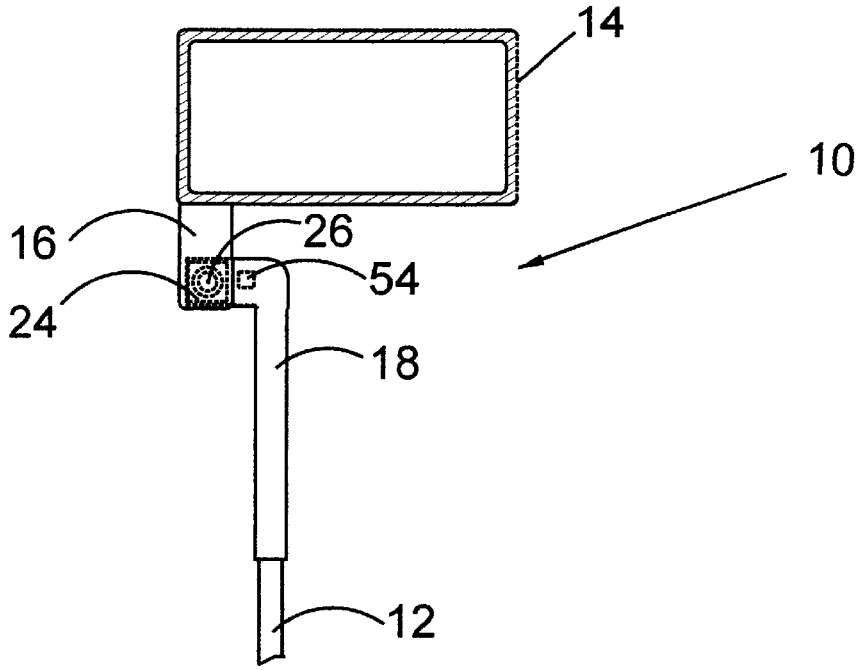
FIG. 12 is a cross-sectional view taken along the line 12—12 of FIG. 6.
Figure 13:
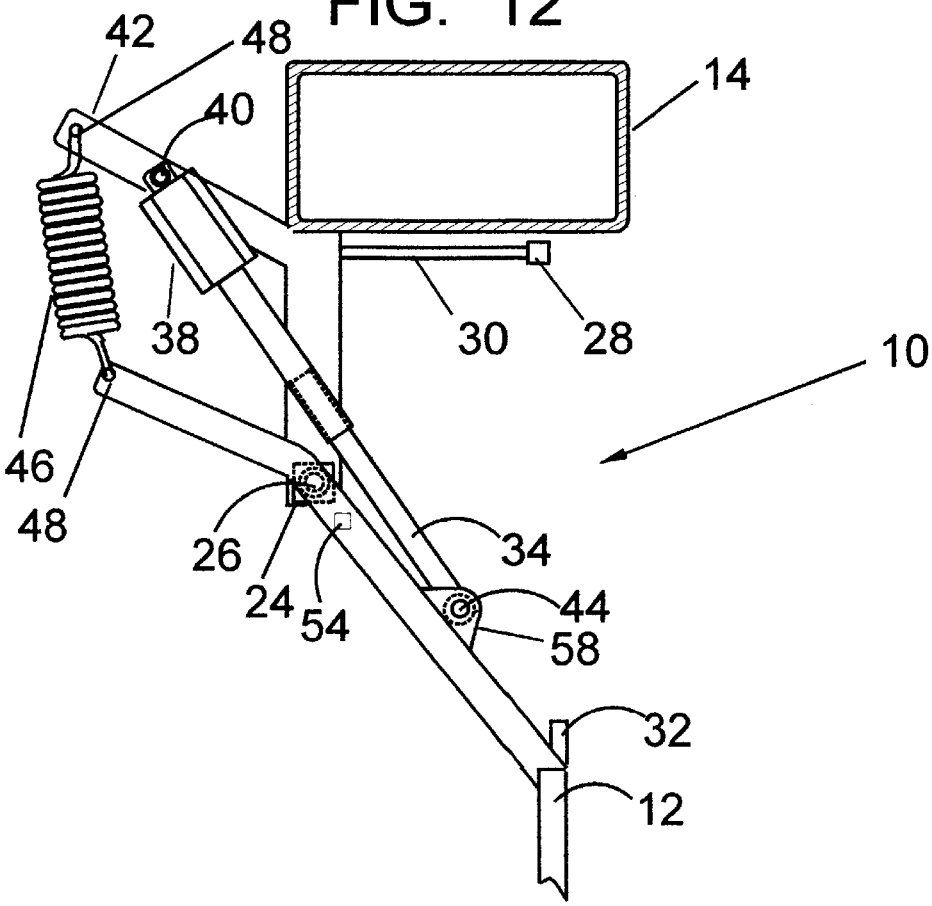
FIG. 13 is a cross-sectional view taken along the line 13—13 of FIG. 3.

Referring now to FIGS. 4–6 and 10–13, an exemplary gate 10 is described. FIG. 4 illustrates a preferred embodiment of the gate from a rear view of the closed gate 10. FIG. 5 illustrates an enlarged rear view of the closed gate 10. FIG. 6 illustrates a side view of the exemplary gate 10 in the. open position. FIGS. 10 and 11 illustrate cross-sectional top views of the exemplary gate 10 in a closed position. FIGS. 12 and 13 illustrate cross-sectional top views of the exemplary gate 10 in the open position.

The gate 10 with barrier element 12 attached to the top bracket 18 and bottom bracket 22. The top and bottom brackets 18 and 22 are each attached to bearings 24. The bearings 24 are attached to top hinge support 16 and bottom hinge support 20. The top hinge support 16 and bottom hinge support 20 are attached to the column 14. A gate opener 34 with motor 38 is attached to the gate opener mount 42 by means of a gate opener swivel joint 40. The opposite end of the gate opener 34 is attached to the bottom bracket 22 by means of a gate joint 44. A biasing member 46 attaches on both of its ends to biasing member mount 48. A column stop 28 is mounted to the bottom hinge support 20. A column stop adjuster 30 is mounted to column stop 28. A connecting member 54 is attached to bottom bracket 22 and to top bracket 18.

The gate opener 34 when activated, extends along its longitudinal axis and pushes the bottom bracket 22 to swing the barrier element 12 attached to the top bracket 18 and bottom bracket 22 around the bearing 24 to open the gate 10. The biasing member 46 biases the bottom bracket 22 and the gate opener mount 36 to assist the gate opener 34 in lifting open the barrier element 12.

Figure 7:
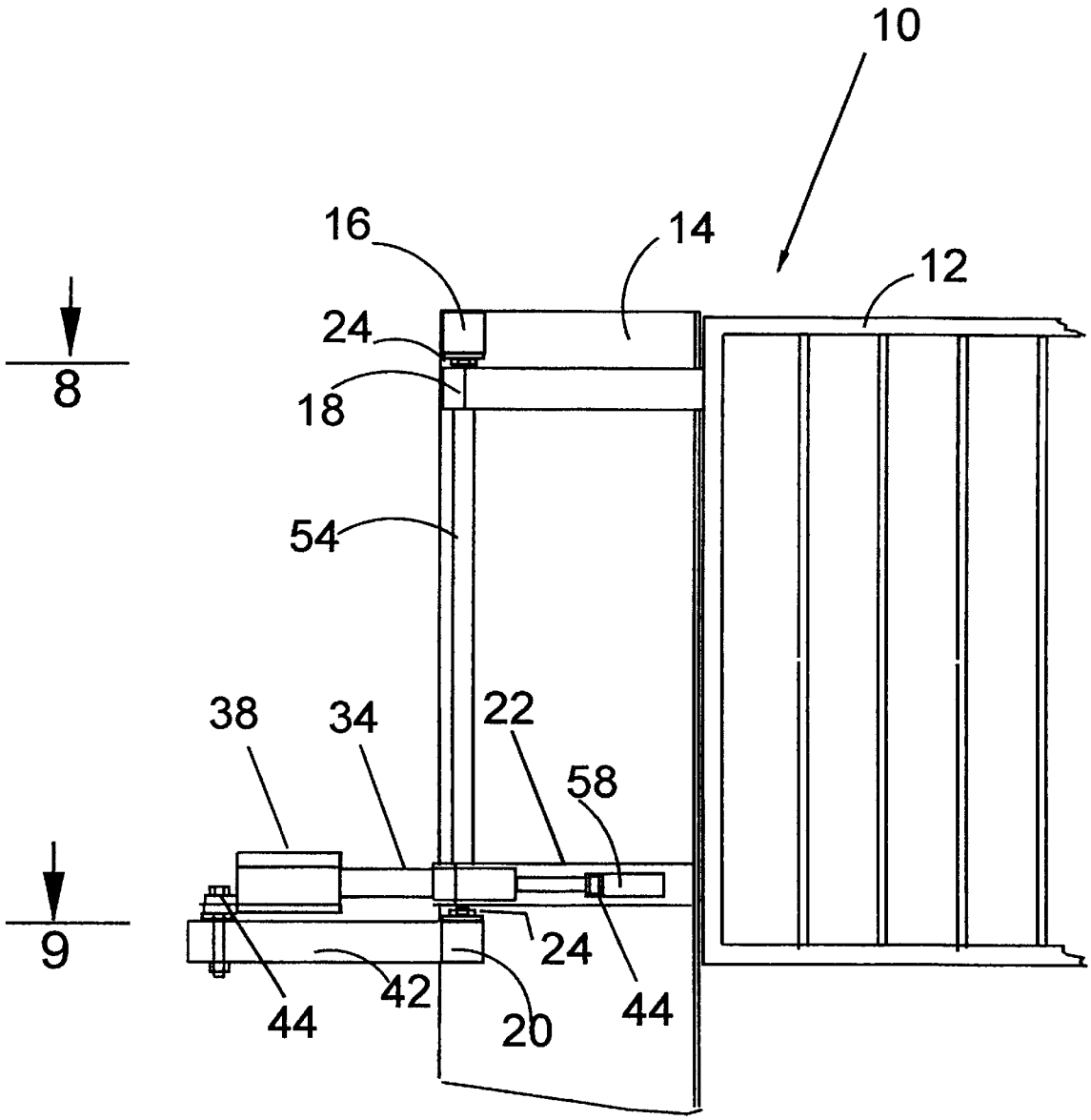
FIG. 7 is a rear elevation view of an exemplary non-lifting gate installation.
Figure 8:
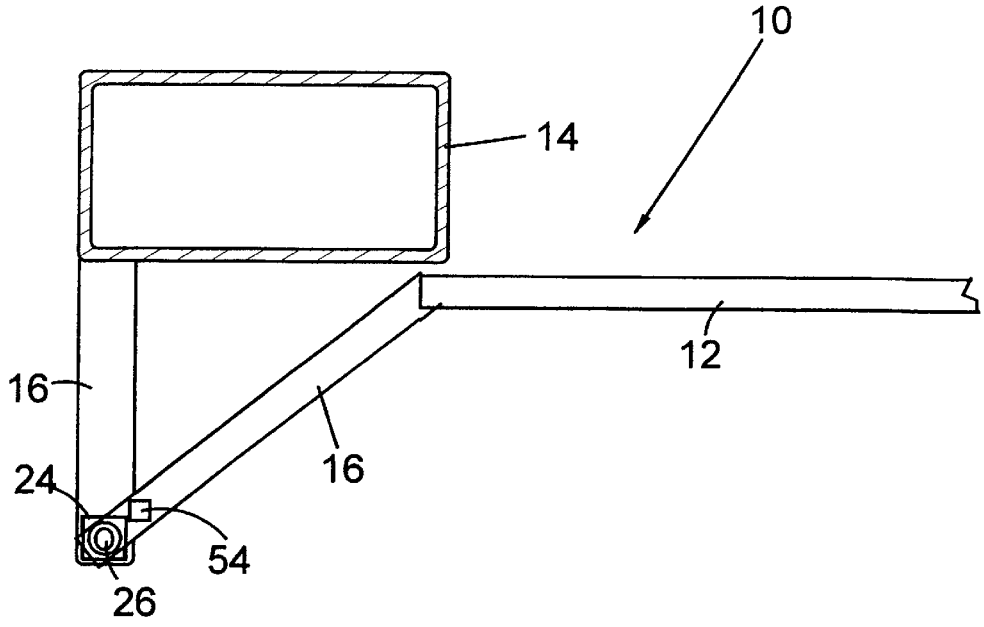
FIG. 8 is a cross-sectional view taken along the line 8—8 of FIG. 7.
Figure 9:
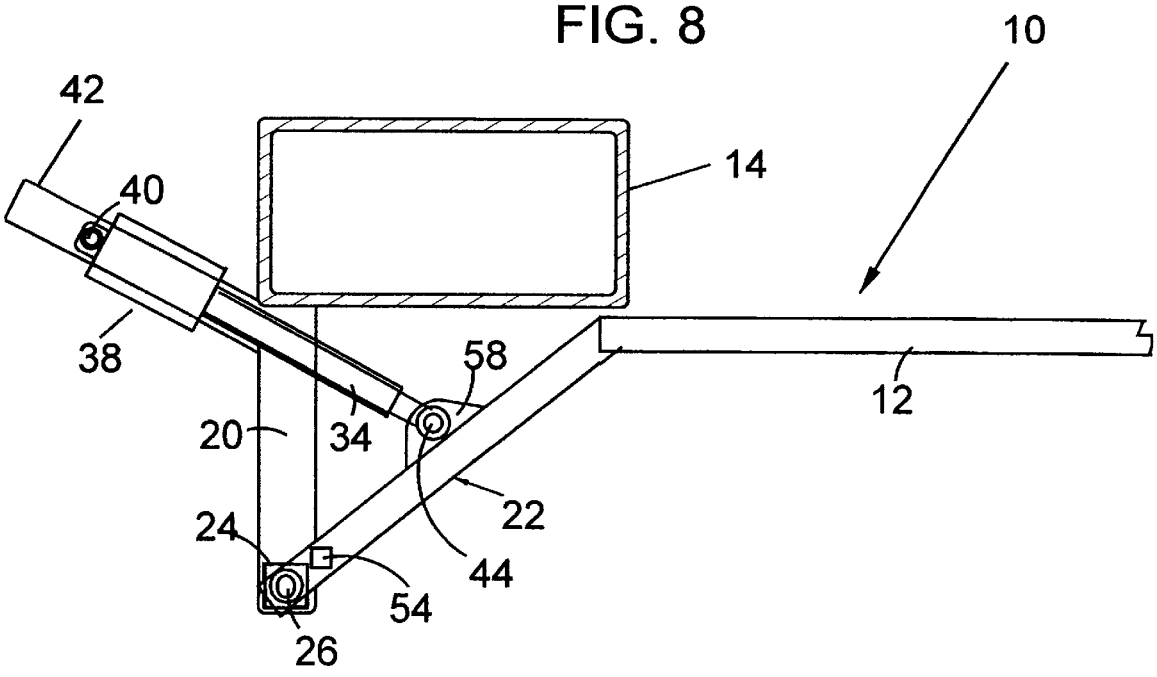
FIG. 9 is a cross-sectional view taken along the line 9—9 of FIG. 7.

An alternate embodiment of the gate illustrated in FIG. 7 (rear view gate closed), FIGS. 8 and 9 (cross-sectional top views of gate closed).

The gate 10 with barrier element 12 is attached to the top bracket 18 and bottom bracket 22. The top and bottom brackets are each attached to bearing 24. The bearings 24 are attached to top hinge support 16 and bottom hinge support 20. The top hinge support 16 and bottom hinge support 20 are attached to the column 14. A gate opener 34 with motor 38 is attached to the gate opener mount 42 by means of a gate opener swivel joint 40. The opposite end of the gate opener 34 is attached to the bottom bracket 22 by means of a gate joint 44. A biasing member 46 attaches on both of its ends to biasing member mount 48. A column stop 28 is mounted to the bottom hinge support 20. A column stop adjuster 30 is mounted to column stop 28. A connecting member 54 is attached to bottom bracket 22 and to top bracket 18.

The gate opener 34 when activated extends along its longitudinal axis and pushes the bottom bracket 22 to swing gate around the bearing 24 to open the gate.

Figure 14:
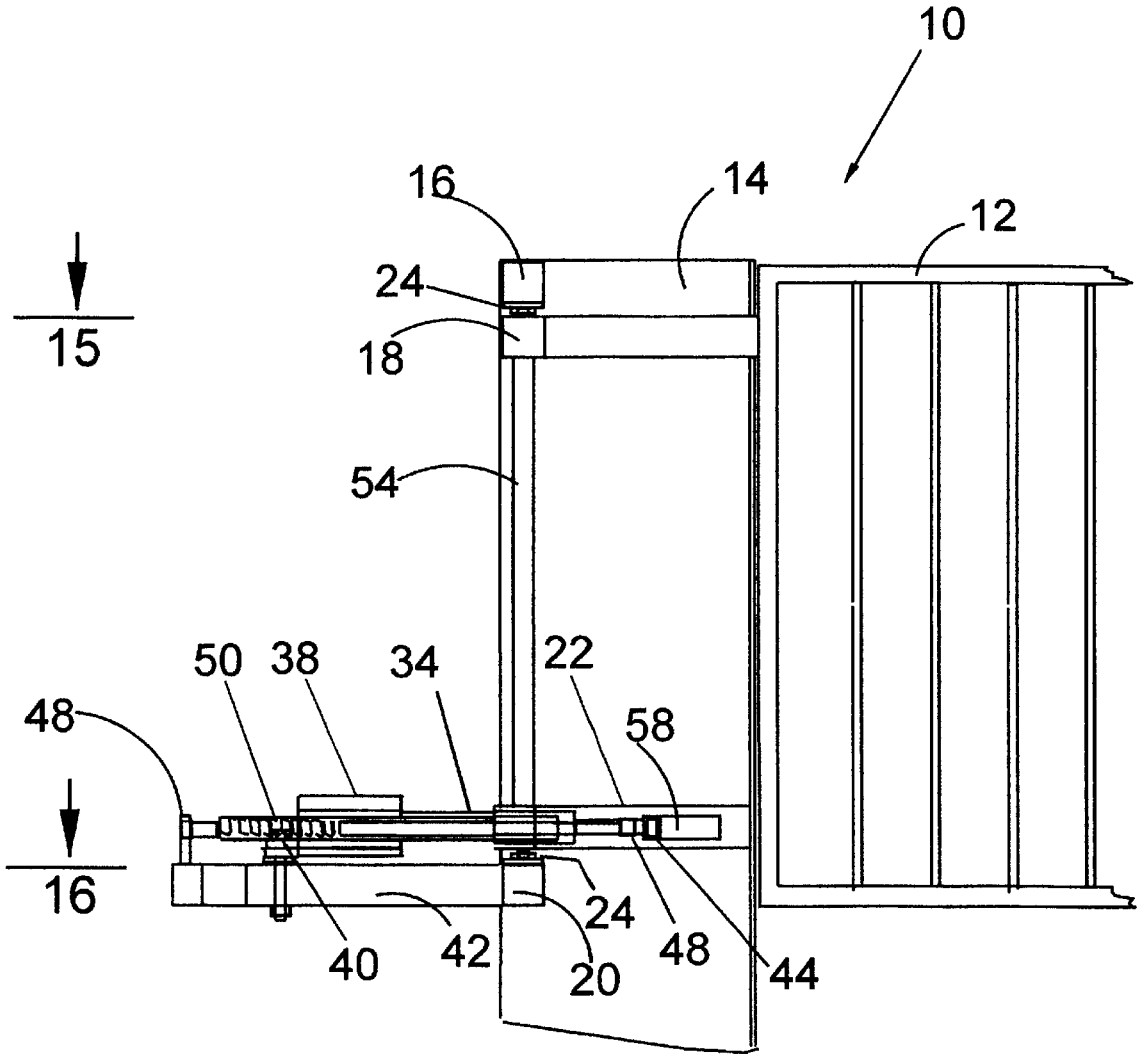
FIG. 14 is a rear elevation view of an exemplary lifting gate installation in the closed position.
Figure 15:
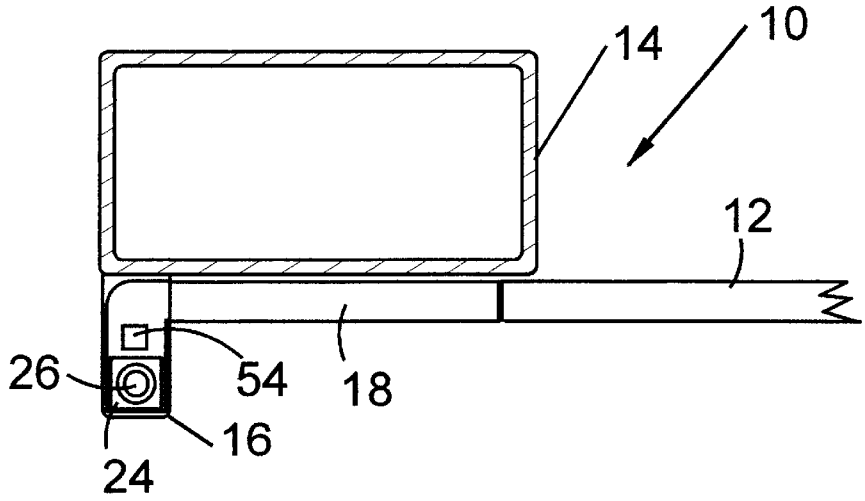
FIG. 15 is a cross-sectional view taken along the line 15—15 of FIG. 14.
Figure 16:
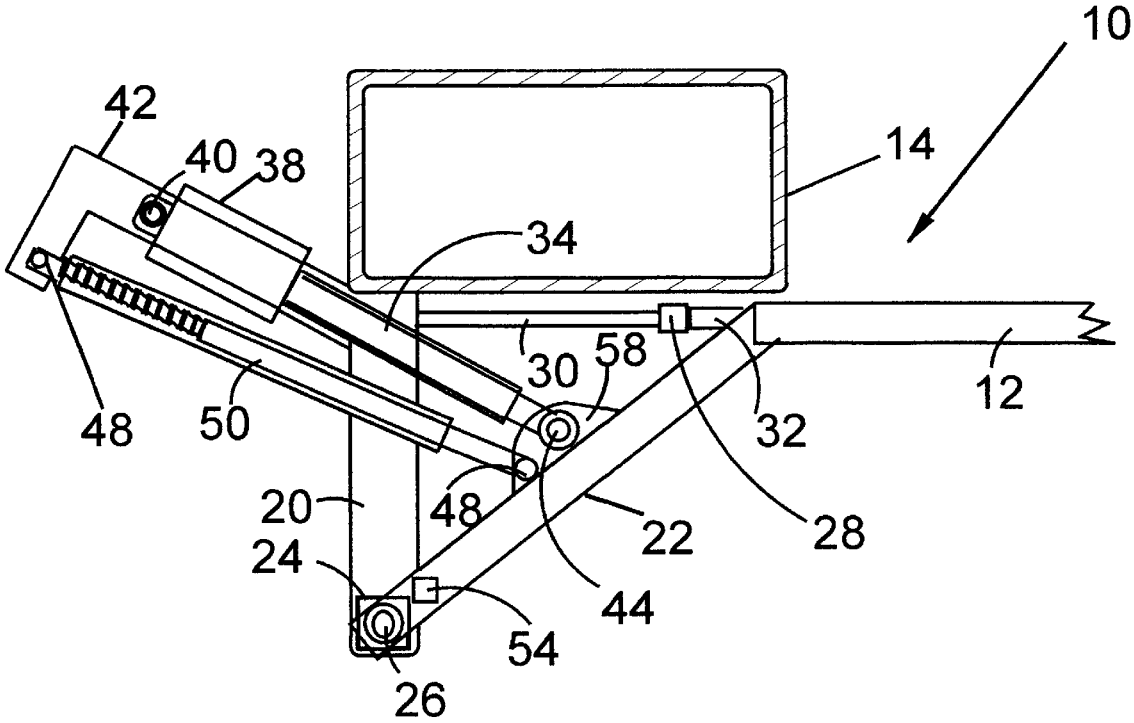
FIG. 16 is a cross-sectional view taken along the line 16—16 of FIG. 14.

An alternate embodiment of the gate illustrated in FIGS. 14 (rear view gate closed), FIGS. 15 and 16 (cross-sectional top views of gate closed).

The gate 10 with barrier element 12 is attached to the top bracket 18 and bottom bracket 22. The top and bottom brackets are each attached to bearing 24. The bearings 24 are attached to top hinge support 16 and bottom hinge support 20. The top hinge support 16 and bottom hinge support 20 are attached to the column 14. A gate opener 34 with motor 38 is attached to the gate opener mount 42 by means of a gate opener swivel joint 40. The opposite end of the gate opener 34 is attached to the bottom bracket 22 by means of a gate joint 44. A compression biasing member 50 attaches on both of its ends to biasing member mount 48. A column stop 28 is mounted to the bottom hinge support 20. A column stop adjuster 30 is mounted to column stop 28. A connecting member 54 is attached to bottom bracket 22 and to top bracket 18.

The gate opener 34 when activated extends along its longitudinal axis and pushes the bottom bracket 22 to swing gate around the bearing 24 to open the gate. The compression biasing member 50 applies force to the bottom bracket 22 and to the gate opener support 42 to assist the gate opener 34 in lifting open the barrier element 12.

Figure 17:
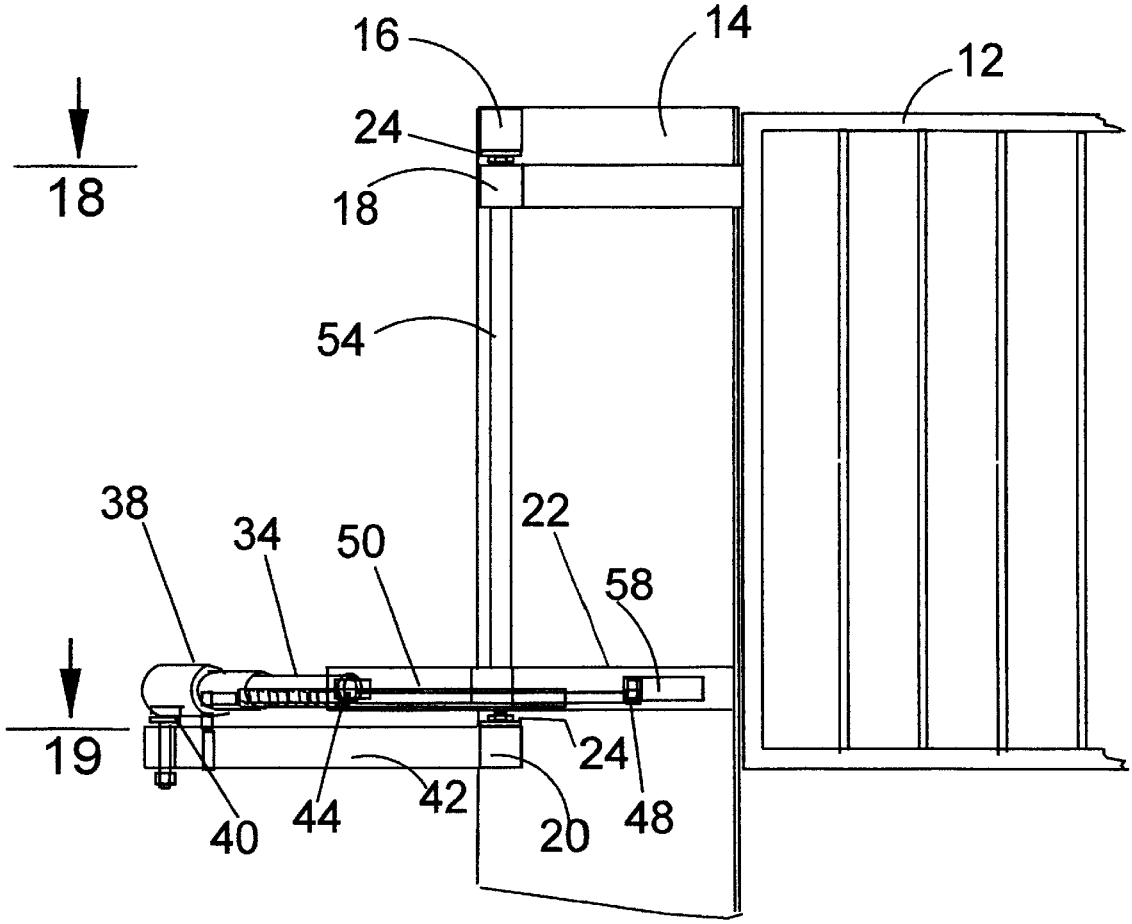
FIG. 17 is a rear elevation view of an exemplary lifting gate installation in the closed position.
Figure 18:
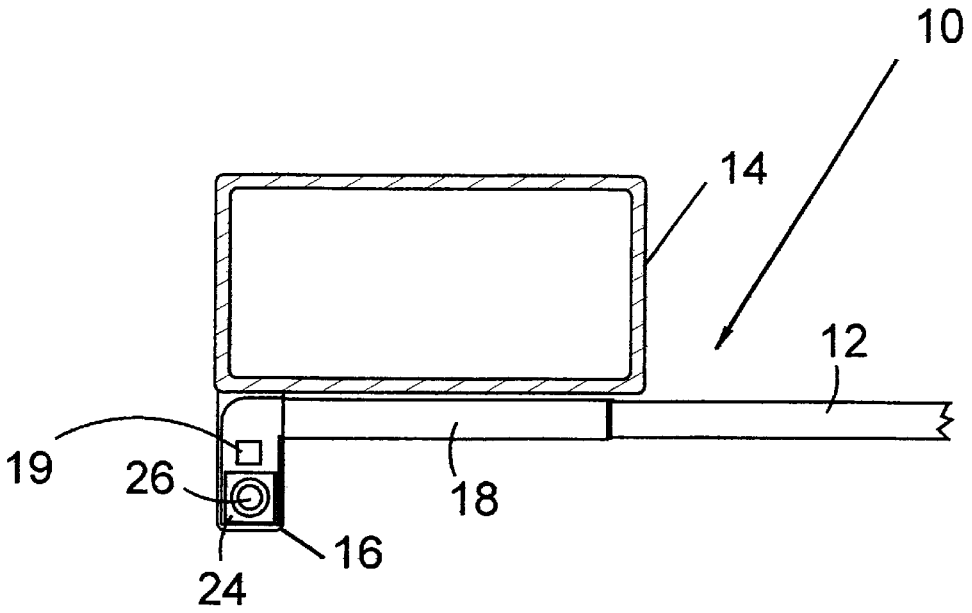
FIG. 18 is a cross-sectional view taken along the line 18—18 of FIG. 17.
Figure 19:
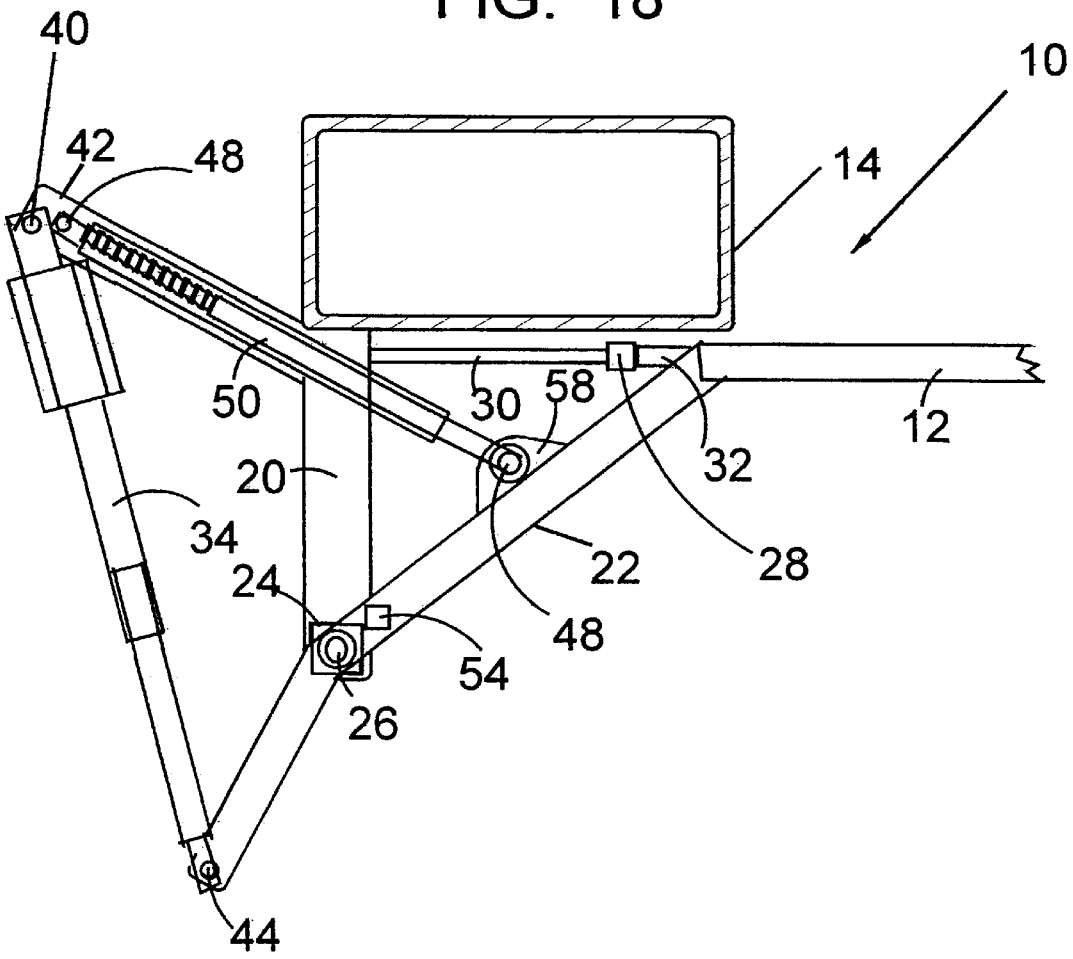
FIG. 19 is a cross-sectional view taken along the line 19—19 of FIG. 17.

An alternate embodiment of the gate illustrated in FIG. 17 (rear view gate closed), FIGS. 18 and 19 (cross-sectional top views of gate closed).

The gate 10 with barrier element 12 is attached to the top bracket 18 and bottom bracket 22. The top and bottom brackets are each attached to bearing 24. The bearings 24 are attached to top hinge support 16 and bottom hinge support 20. The top hinge support 16 and bottom hinge support 20 are attached to the column 14. A gate opener 34 with motor 38 is attached to the gate opener mount 42 by means of a gate opener swivel joint 40. The opposite end of the gate opener 34 is attached to the bottom bracket 22 by means of a gate joint 44. A compression biasing member 50 attaches on both of its ends to biasing member mount 48. A column stop 28 is mounted to the bottom hinge support 20. A column stop adjuster 30 is mounted to column stop 28. A gate stop 32 is coupled to the column stop. A connecting member 54 is attached to bottom bracket 22 and to top bracket 18.

The gate opener 34 when activated contracts along its longitudinal axis and pulls the bottom bracket 22 to swing gate around the bearing 24 to open the gate. The compression biasing member 50 applies force to the bottom bracket 22 and to the gate opener support 42 to assist the gate opener 34 in lifting open the barrier element 12.

Accordingly, the present invention provides a strong reliable gate hinge assembly that takes into account the very steeply sloping contour of the adjacent terrain and/or snow in the vicinity of the gate and: a simple counterbalance system to assist in neutralizing the large force needed in the opening of a large driveway gate to heights of ten feet and more measured at the outside radius of the gate; an easy preset attachment point for commercially available actuator arm gate openers to open lifting or non-lifting gates of any size; an aesthetically pleasing location for the gate operator adjacent to the outside face of the post with no unsightly visible attachment point to the gate; an optimization of the hinge geometry with the bottom hinge bracket rotation advanced in the opening direction ahead of the top hinge bracket to allow the bottom hinge to rotate through its maximum lift radius to lift the gate more quickly at the start of the swing of the gate; stop at the bottom hinge to stop gate sag in closed gate position incurred with the optimized hinge geometry; and a safe gate inhibited from accidentally slamming shut from the raised opened position.

While embodiments and applications of this disclosure have been illustrated and described, it would be apparent to those skilled in the art that many more modifications than mentioned above are possible without departing from the inventive concepts herein. The disclosure, therefore, is not to be restricted except in the spirit of the appended claims.

What is claimed is:

1. A lifting gate comprising:

a barrier member having a top and a bottom opposite thereof;

a top bracket assembly coupled to said top of said barrier member, said top bracket assembly including a top bearing coupled to a top bracket and a top hinge support coupled to said top bearing;

a bottom bracket coupled to said bottom of said barrier member, having a body defined by a first bracket end and a second bracket end and a central bracket portion between said first and second bracket ends, said bottom bracket coupled to said bottom of said barrier member proximate to said first bracket end;

a bottom bearing coupled to said bottom bracket proximate to said central bracket portion;

a bottom hinge support having a first support end and a second support end opposite thereof and a central support portion between said first and second support ends, said bottom hinge support being coupled to said bottom bearing proximate to said central support portion;

a gate opener having a first opener end and a second opener end opposite thereof, said gate opener being coupled to said bottom hinge support and said gate opener being coupled to said bottom bracket; and a biasing member coupled to said bottom hinge support and coupled to said bottom bracket.

2. The lifting gate of claim 1 further comprising:

a column having a top and a bottom, said bottom being partially embedded into earth; said top of said column being coupled to said top hinge support and said bottom of said column being coupled to said central support portion of said bottom hinge support, wherein said bottom bearing coupled to said bottom hinge support is mounted a greater distance from said column than said top bearing.

3. The lifting gate of claim 1 wherein said gate opener includes a gate opener motor.

4. The lifting gate of claim 1 wherein said first opener end of said gate opener is coupled to said bottom hinge support at a gate opener swivel joint located proximate to said second support end and said second opener end of said gate opener is coupled to said bracket mount located on said bottom bracket between said central bracket portion and said first bracket end and said biasing member includes a first end and a second end opposite thereof, said first end of said biasing member is coupled to said bottom hinge support proximate to said second support end and said second end of said biasing member is coupled to said bottom bracket proximate to said second bracket end.

5. The lifting gate of claim 1 wherein said first opener end of said gate opener is coupled to said bottom hinge support at a gate opener swivel joint located proximate to said second support end and said second opener end of said gate opener is coupled to a bracket mount located on said bottom bracket between said central bracket portion and said first bracket end, said biasing member includes a first end and a second end opposite thereof and said first end of said biasing member is coupled to said bottom hinge support proximate to gate opener swivel joint located proximate to said second support end and said second end of said biasing member is coupled proximate to said bracket mount located on said bottom bracket between said central bracket portion and said first bracket end.

6. The lifting gate of claim 1 wherein said first opener end of said gate opener is coupled to said bottom hinge support at a gate opener swivel joint located proximate to said second support end and said second opener end of said gate opener is coupled to a bracket mount located on said bottom bracket between said central bracket portion and said first bracket end, said biasing member includes a first end and a second end opposite thereof and said first end of said biasing member is coupled to said bottom hinge support proximate to said second support end and said second end of said biasing member is coupled at said bracket mount located on said bottom bracket between said central bracket portion and said first bracket end.

7. The lifting gate of claim 1 wherein said first opener end of said gate opener is coupled to said bottom hinge support at a gate opener swivel joint located proximate to said second support end and said second opener end of said gate opener is coupled to a gate swivel joint located on said bottom bracket proximate to said second bracket end, said biasing member includes a first end and a second end opposite thereof and said first end of said biasing member is coupled to said bottom hinge support proximate to said second support end and said second end of said biasing member is coupled to said bottom bracket between said central bracket portion and said first bracket end.

8. The lifting gate of claim 1 wherein said first opener end of said gate opener is coupled to said bottom hinge support at a gate opener swivel joint located proximate to said second support end and said second opener end of said gate opener is coupled to a gate swivel joint located on said bottom bracket proximate to said second bracket end, said biasing member includes a first end and a second end opposite thereof and said biasing member is a compression biasing member, wherein said first end of said compression biasing member is coupled to said bottom hinge support proximate to said second support end and said second end of said compression biasing member is coupled to said bottom bracket between said central bracket portion and said first bracket end.

9. The lifting gate of claim 1 further comprising:

a gate stop coupled to said bottom hinge support.

10. The lifting gate of claim 1 further comprising:

a column stop coupled to said bottom hinge support; and a column stop adjuster coupled to said column stop.

11. The lifting gate of claim 1 further comprising:

a column stop coupled to said bottom hinge support;

a column stop adjuster coupled to said column stop; and a gate stop coupled to said column stop opposite said column stop adjuster.

12. The lifting gate of claim 1 further comprising:

a connecting rod coupled between said top bearing and said bottom bearing.

13. A lifting gate comprising:

a barrier member having a top and a bottom opposite thereof;

a top bracket assembly coupled to said top of said barrier member, said top bracket assembly including a top bearing coupled to a top bracket and a top hinge support coupled to said top bearing;

a bottom bracket coupled to said bottom of said barrier member, having a body defined by a first bracket end and a second bracket end and a central bracket portion between said first and second bracket ends, said bottom bracket coupled to said bottom of said barrier member proximate to said first bracket end;

a bottom bearing coupled to said bottom bracket proximate to said central bracket portion;

a bottom hinge support having a first support end and a second support end opposite thereof and a central support portion between said first and second support ends, said bottom hinge support being coupled to said bottom bearing proximate to said central support portion;

a gate opener having a first opener end and a second opener end opposite thereof, said gate opener being coupled to said bottom hinge support and said gate opener being coupled to said bottom bracket.

14. The lifting gate of claim 13 further comprising:

a biasing member coupled to said bottom hinge support and coupled to said bottom bracket.

* * * * *